US008893734B2

(12) United States Patent
McLain

(10) Patent No.: US 8,893,734 B2
(45) Date of Patent: Nov. 25, 2014

(54) BUFFING PAD WASHER FOR USE WITH MULTIPLE TYPES OF POWER DRIVERS

(75) Inventor: Scott S. McLain, Mukwonago, WI (US)

(73) Assignee: Lake Country Manufacturing, Inc., Hartland, WI (US)

( * ) Notice: Subject to any disclaimer, the term of this patent is extended or adjusted under 35 U.S.C. 154(b) by 773 days.

(21) Appl. No.: 13/116,560

(22) Filed: May 26, 2011

(65) Prior Publication Data

US 2012/0298148 A1 Nov. 29, 2012

(51) Int. Cl.

| | |
|---|---|
| ***B08B 3/02*** | (2006.01) |
| ***B08B 1/00*** | (2006.01) |
| ***B24B 53/007*** | (2006.01) |
| ***B24D 13/00*** | (2006.01) |

(52) U.S. Cl.

CPC ..... *B24B 53/007* (2013.01); *B08B 1/00* (2013.01); *B08B 1/007* (2013.01); *B24D 13/00* (2013.01)

USPC ..... 134/104.2; 134/140; 134/147; 134/157; 15/104.92

(58) Field of Classification Search

USPC ..... 134/104.2, 140, 147, 157; 15/1, 104.92, 15/142, 257.01, 260

See application file for complete search history.

(56) References Cited

U.S. PATENT DOCUMENTS

| | | | | |
|---|---|---|---|---|
| 3,522,814 | A * | 8/1970 | Olson | 134/111 |
| 4,786,333 | A | 11/1988 | Kaiser | |
| 4,983,221 | A * | 1/1991 | Kaiser | 134/6 |
| 5,471,726 | A | 12/1995 | Kaiser | |
| 5,682,638 | A | 11/1997 | Kaiser | |
| 7,716,778 | B2 | 5/2010 | Meister | |
| 2008/0173337 | A1 * | 7/2008 | Lamb | 134/154 |

OTHER PUBLICATIONS

International Search Report and Written Opinion for PCT/US2012/037731 dated Sep. 25, 2012.

* cited by examiner

*Primary Examiner* — Saeed T Chaudhry
(74) *Attorney, Agent, or Firm* — Andrus Intellectual Property Law, LLP

(57) ABSTRACT

A cleaning apparatus for a power driven buffing pad includes a wash plate mounted in a cleaning solution reservoir that provides agitating and cleaning contact with the pad mounted on an operating driver. The wash plate can be reciprocated vertically by the operator against a biasing arrangement to operate a pump to deliver cleaning solution from the reservoir to the face of the pad in contact with the wash plate.

23 Claims, 7 Drawing Sheets

BUFFING PAD WASHER FOR USE WITH MULTIPLE TYPES OF POWER DRIVERS

BACKGROUND

The present application relates to an apparatus for cleaning power driven buffing pads. In particular, the application pertains to an apparatus that utilizes a positive displacement pump that is manually driven by the operator to supply cleaning solutions to a wash plate contacted by the operating pad, and a multi-function catch basin for cleaning solution that can be used to clean pads that are mounted on rotary, dual action or random orbital buffing machines.

The prior art teaches a number of buffing pad cleaning devices in which the buffing pad may be washed or cleaned while mounted on a powered drive machine by enclosing the pad in the upper portion of a cylindrical reservoir in contact with agitating wheels or protuberances while a liquid cleaning solution is delivered from the bottom of the reservoir upwardly to the face of the rotating buffing pad. Such prior art apparatus has included electrically driven systems and systems driven by rotation of the pad itself.

In all of the prior art pad cleaning devices, cleaning solution is recirculated and reused until the reservoir is emptied and fresh cleaning solution is supplied to the reservoir. As a result, the cleaning solution continuously becomes dirtier and degrades. As a result, pad cleaning performance also degrades.

SUMMARY

In accordance with the present application, a buffing pad washing apparatus includes a cleaning solution pump which is operated by vertical reciprocal movement of the pad contacting face of the washing apparatus by the machine operator. A positive displacement pump in the reservoir is operated in response to the operator applying vertical reciprocating movement to the pad contact face, provided with an array of cleaning solution delivery apertures, right to the face of the pad as it moves against and over the contact surface.

The pad washing apparatus of the present application is dimensioned to be supported on the rim of a conventional five gallon plastic pail to extend downwardly into the open interior thereof containing a liquid pad cleaning solution filling the reservoir to a desired depth or specific volume, all as will be described in greater detail below.

In one embodiment, the apparatus is supported on a base plate which, in turn, is supported on the upper edge or rim of the reservoir. The base plate has an outer wall that extends downwardly into the open upper end of the reservoir and has an annular and generally horizontal bottom support surface. A wash plate has a foraminous upper pad contacting surface that is supported over the base plate support surface and is connected thereto with a biasing arrangement adapted to permit vertical movement of the wash plate in response to manual downward operator movement of the pad face against the surface of the wash plate. A positive displacement pump is mounted in the reservoir and includes a cleaning solution inlet on a lower end and a housing that includes a cleaning solution outlet on an upper end in liquid communication with the wash plate. The pump housing is attached to the base plate support surface and has a spring-biased pump actuating plunger that includes the cleaning solution outlet and is in operative engagement with a lower wash plate surface to deliver cleaning solution from the pump outlet through the foraminous surface of the wash plate and against the pad face in response to the downward operator movement of the wash plate.

In an additional embodiment, the biasing arrangement comprises a plurality of compression springs that are captured between the lower wash plate surface and the base plate support surface. Each of the compression springs is mounted on a stud that depends downwardly from the underside of the wash plate with the lower end of the stud extending through the base plate support surface and held by a connector attached to the lower end of the stud to place the springs in an initial level of compression. The stud ends and connectors, along with the wash plate, are permitted to move downwardly, causing a higher level of spring compression in response to the downward operator movement. Downward movement of the wash plate is limited by contact of the lower wash plate surface with the annular support surface of the base plate. Preferably, the outer wall of the base plate includes an annular shoulder that defines a radially outer upper support surface and a central recess that defines a lower support surface. The upper support surface comprises the limit to downward vertical movement of the wash plate. The upper support surface and the lower support surface of the base plate are provided with drain holes.

The biasing arrangement includes tubular guide sleeves positioned on the studs between each compression spring and the base plate support surface to confine the studs to vertical movement. The guide sleeves are formed integrally with and extend upwardly from the base plate.

The apparatus includes an optional catch basin which receives and is demountably attached to the outer wall of the base plate. Alternately, the catch basin may be attached to the underside of the base plate, such as the upper support surface. The catch basin has an annular bottom chamber that defines a vertical opening for receipt therethrough of the pump housing. The bottom chamber of the catch basin includes optional drain holes for the return of cleaning solution to the reservoir. The catch basin may include a replaceable cleaning solution filter in the bottom chamber.

In one embodiment, the wash plate has an inverted dish-shaped upper surface that is provided with a plurality of circumferentially spaced radial ribs that are separated by recessed radial upper surface portions. The upper surface portions have outlet holes defining the foraminous surface. The studs for the biasing arrangement are insert molded into the underside of the wash plate. Alternately, the studs may be threaded into the underside of the wash plate.

The apparatus also includes a removable lid that is operatively supported on the upper edge of the reservoir and is movable to an open position to receive the buffing pad and to a closed position for cleaning.

In another embodiment, the base plate is supported on the upper edge of the reservoir and has an outer wall that includes an annular shoulder defining a radially outer upper support surface and a central recess defining a lower support surface. The foraminous wash plate is supported over the base plate and has an circular outer edge portion that is spaced vertically above the upper support surface in a rest position. The wash plate is connected to the base plate with a biasing arrangement positioned between the underside of the wash plate and the lower support surface. The biasing arrangement is operative to hold the wash plate in the rest position and to permit vertical downward movement of the wash plate to a stop position in contact with the upper support surface in response to manual downward operator movement of the pad face against the wash plate. The apparatus includes a pump that has an inlet for cleaning solution in the reservoir and an outlet in liquid communication with a chamber on the underside of the wash plate. The pump includes a spring-biased pumping plunger that is operable in response to biased vertical reciprocal movement of the wash plate to deliver cleaning solution to the chamber, through the foraminous wash plate and against the face of the pad.

The biasing arrangement and the pump plunger extend downwardly from the wash plate into the base plate central recess. The upper support surface and the lower support surface of the base plate are provided with drain holes. The pump includes a pump housing that is attached to and extends through the lower support face of the base plate.

In an additional embodiment, the pad cleaning apparatus is supported on the rim of and extends downwardly into an open-ended reservoir that contains a liquid cleaning solution. The apparatus comprises a base plate that is supported on the rim of the reservoir and has a cylindrical outer wall and a lower enclosing support surface. A foraminous wash plate is supported over the base plate support surface with a biasing arrangement positioned between the underside of the wash plate and the support surface. The biasing arrangement is operative to hold the wash plate in a rest position and to permit vertical downward movement of the wash plate relative to the base plate to a stop position in response to manual downward operator movement of the pad face against the wash plate. The apparatus includes a pump having an inlet for cleaning solution in the reservoir and an outlet in liquid communication with the underside of the wash plate. The pump has a spring-biased pumping plunger that is operable in response to biased vertical reciprocal movement of the wash plate to deliver cleaning solution to the underside of the wash plate, through the foraminous wash plate and against the face of the pad.

A catch basin is demountably attached to the base plate and extends downwardly from the base plate support surface. The catch basin has a lower bottom wall that is provided with drain openings for returning cleaning solution to the reservoir. Preferably, the lower bottom wall is provided with a plurality of knock-outs defining, when removed, the drain openings.

DETAILED DESCRIPTION

Figure 1:
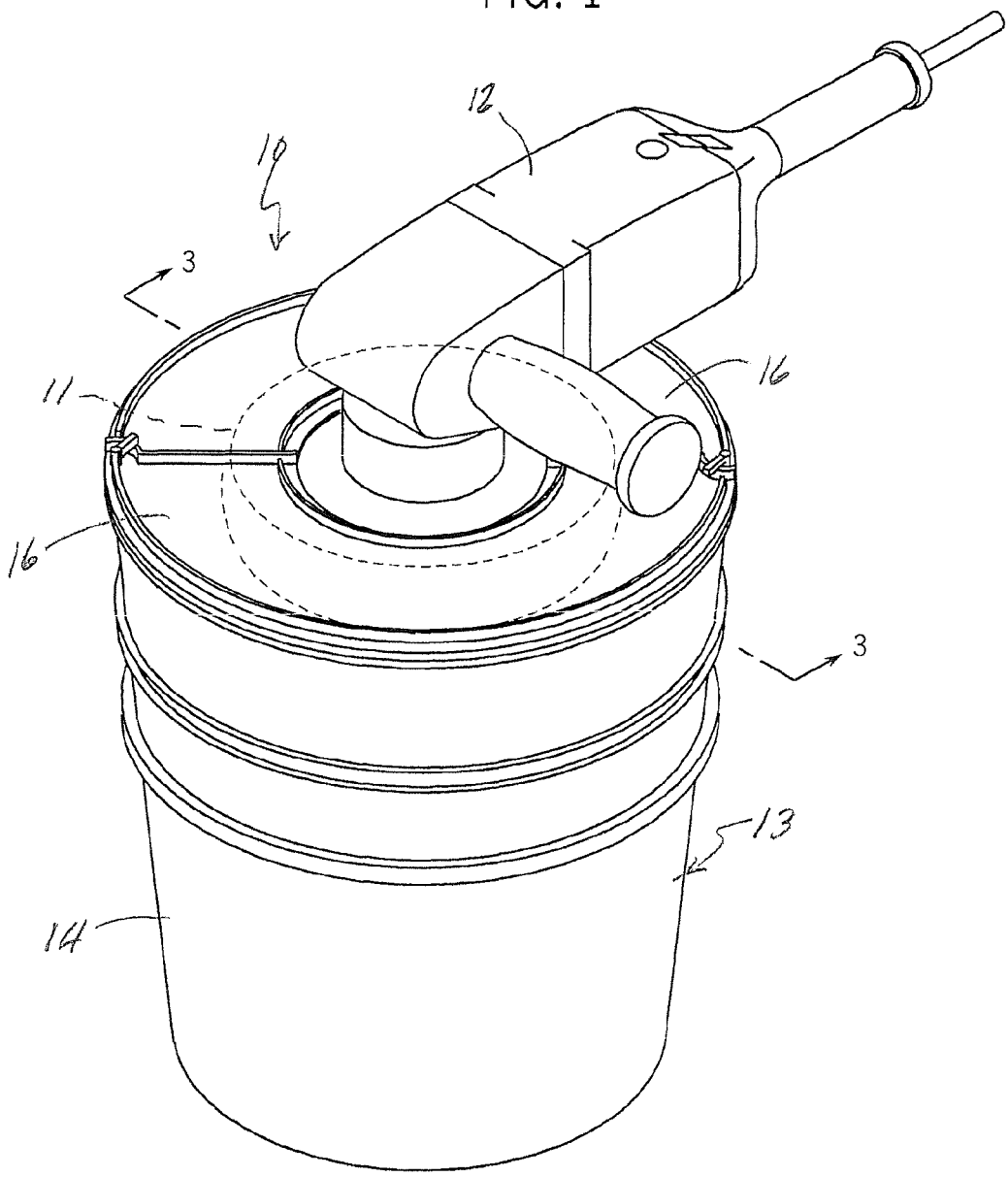
FIG. 1 is a perspective view of the apparatus of the present invention and shows a power driven buffing machine positioned in a pad cleaning position with the pad partially enclosed in a reservoir for cleaning.
Figure 2:
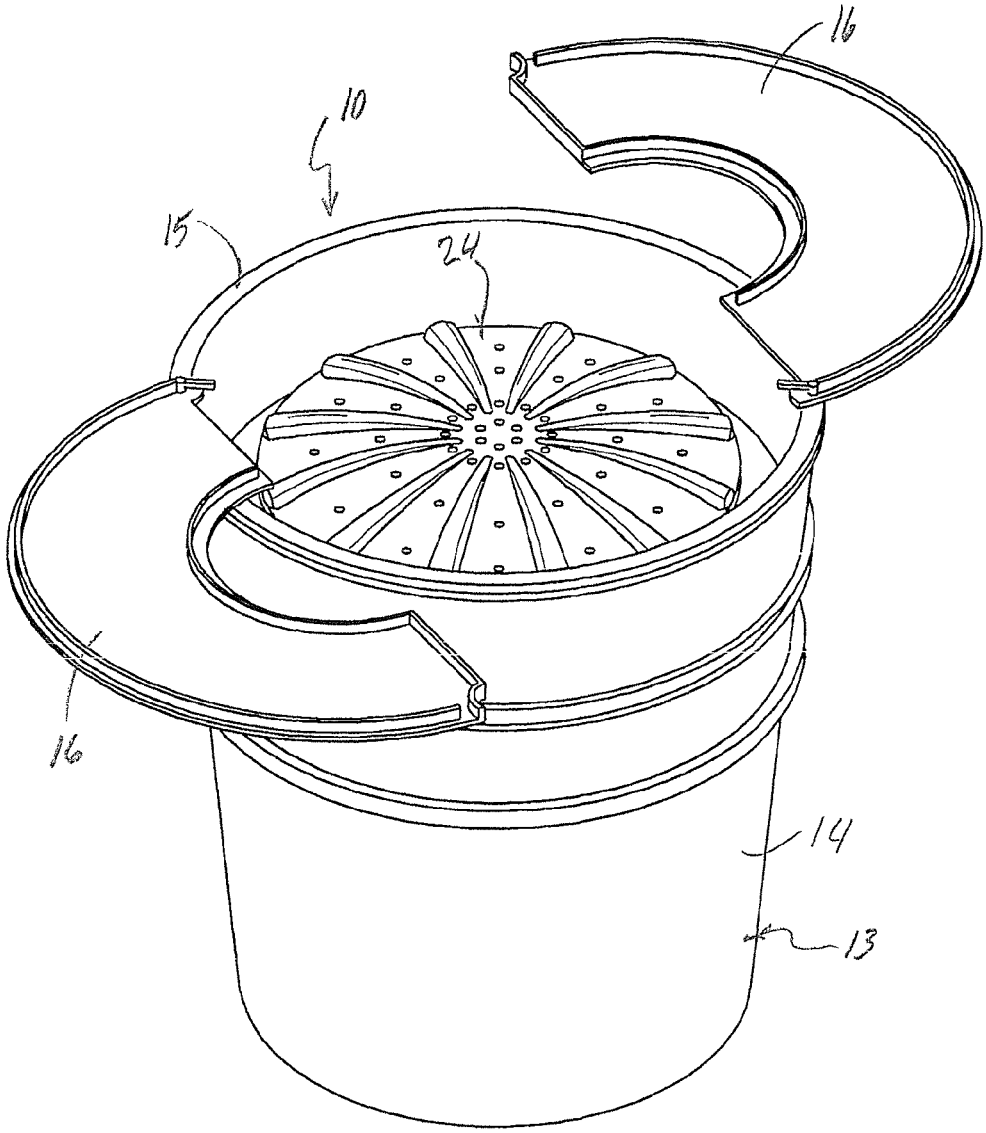
FIG. 2 is a perspective view similar to FIG. 1, but with the driver and pad removed and the reservoir lid in the open position.

Referring initially to FIGS. 1 and 2, the buffing pad washing or cleaning apparatus 10 of the present application is operable to clean a circular buffing pad 11 while the pad is mounted on and driven by a powered driver 12 of a type well known in the art. The cleaning apparatus 10 is entirely contained within a reservoir 13 which, for convenience and economy, may comprise a conventional five gallon plastic bucket. The reservoir includes an outer wall 14 that terminates in a peripheral upper edge 15 on which the cleaning apparatus 10 is mounted, as will be discussed is greater detail below. Pivotally mounted on the upper edge 15 of the reservoir 13 is a pair of semi-circular lid halves 16 which, when open as shown in FIG. 2, permits the buffing pad 11 and the drive end of the powered driver 12 to be placed in the reservoir to rest on the cleaning apparatus 10. The lid halves 16 are closed, as shown in FIG. 1, during cleaning with the operator holding the powered driver 12.

The cleaning apparatus 10 includes a supporting base plate 17 that, in turn, is supported on the upper edge 15 of the reservoir 13 between the upper edge and the lid halves. The base plate has an outer wall 18 that extends downwardly into the open upper end of the reservoir. The base plate outer wall joins an annular bottom support surface 19 that is stepped to form an annular shoulder 20 defining a radially outer upper support surface 21, a central recess 22 and a lower support surface 23.

Figure 3:
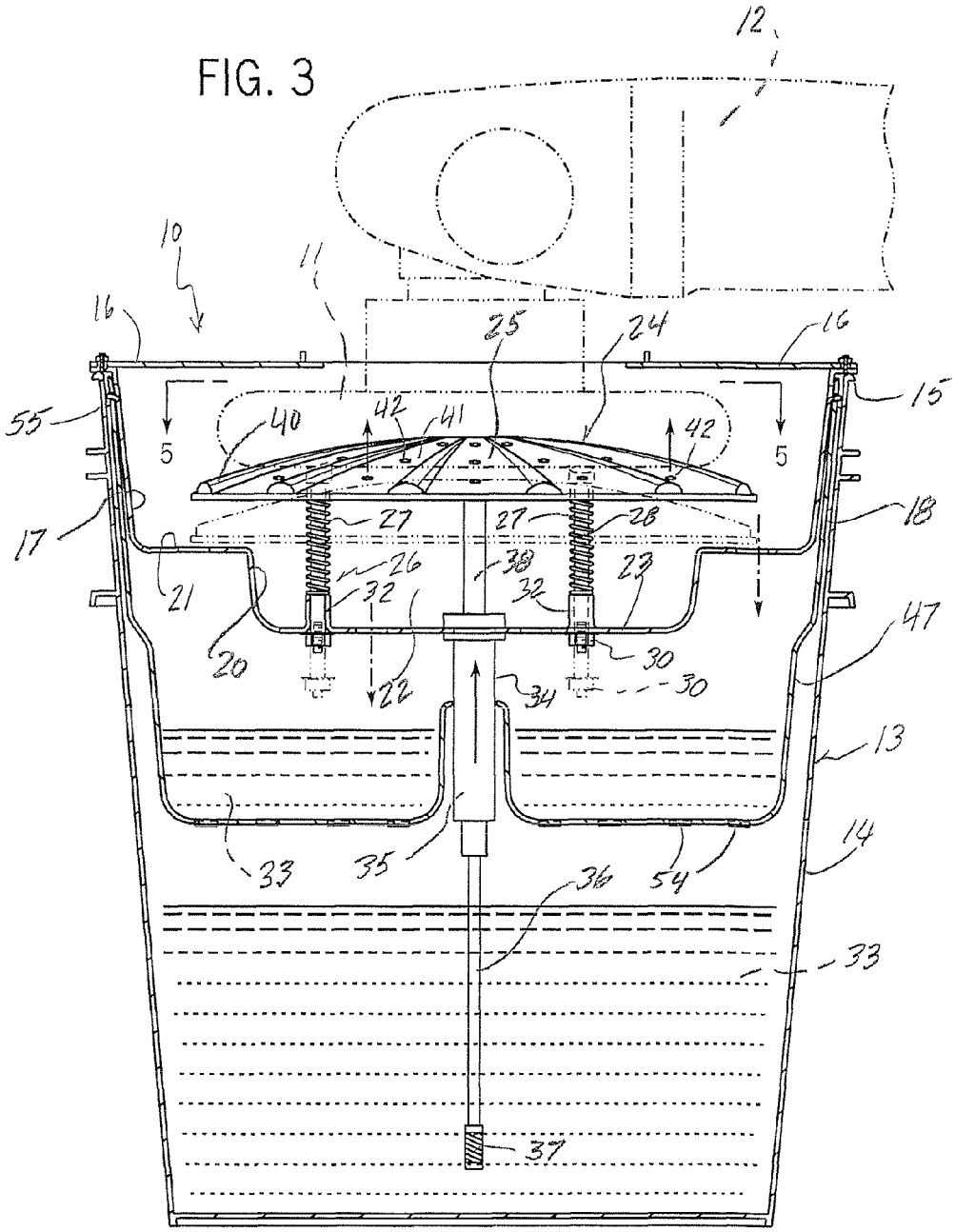
FIG. 3 is a vertical sectional view of the apparatus of the present application showing in phantom the buffing pad attached to the powered buffing machine.
Figures 4, 4A:
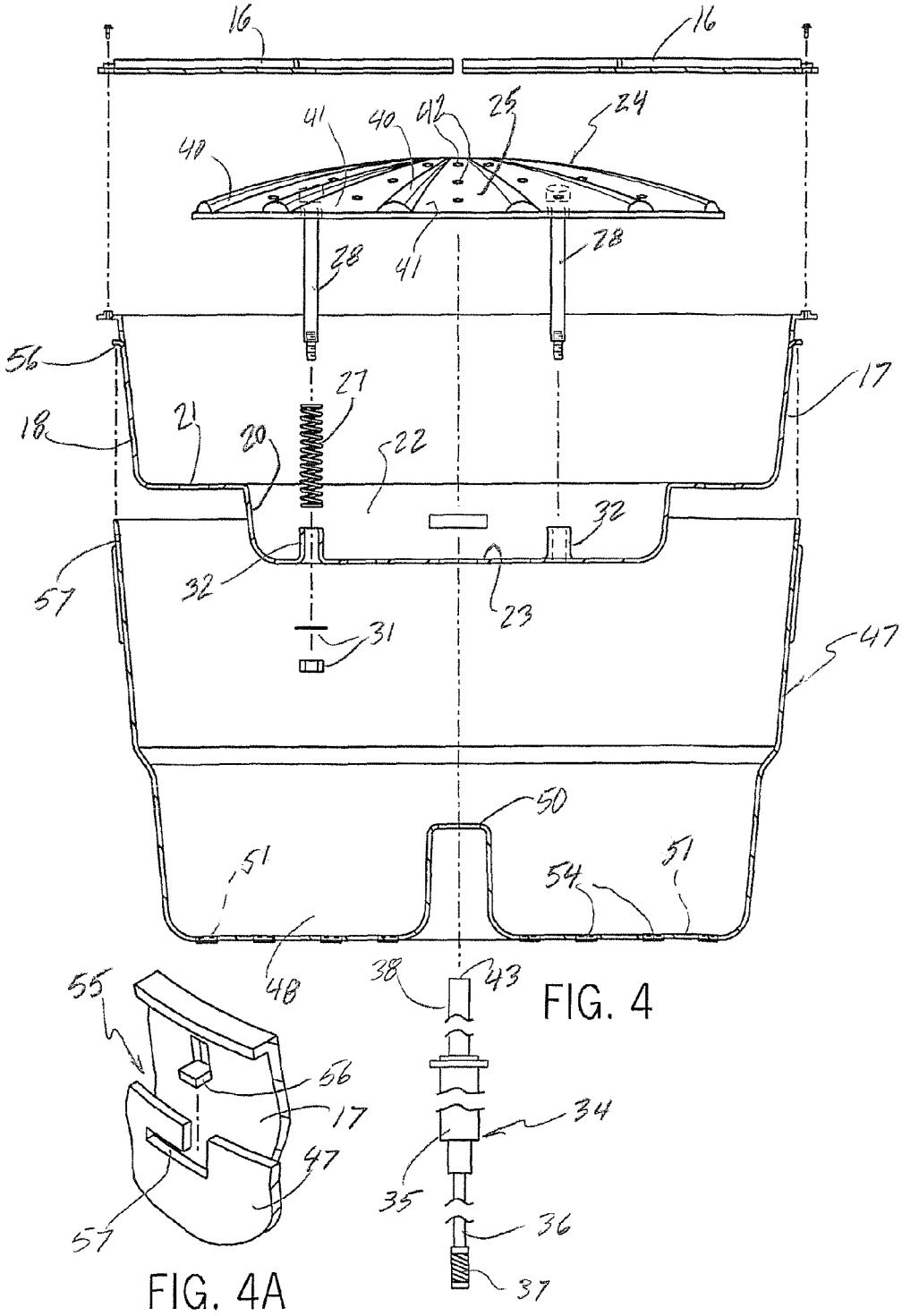
FIG. 4 is an exploded sectional view of the cleaning apparatus without the lower supporting reservoir.
FIG. 4A is a detail of a bayonet connector, a plurality of which are used to demountably attach the catch basin to the base plate.
Figure 6:
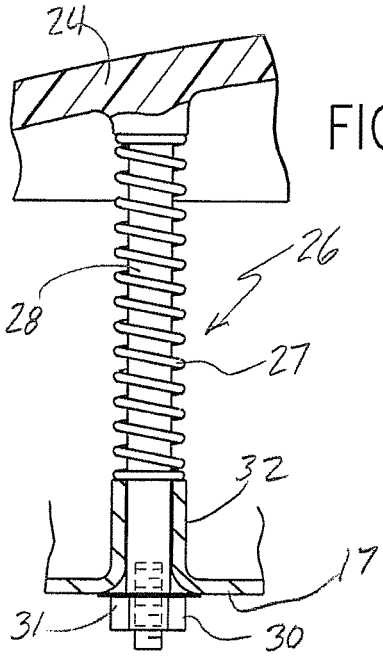
FIG. 6 is an enlarged detail taken on line 6-6 of FIG. 5.

Referring also to FIGS. 3 and 4, a wash plate 24 having a foraminous upper surface 25 is supported over and attached to the base plate lower support surface 23 with a biasing arrangement 26 that permits vertical movement of the wash plate 24 in response to manual downward operator movement of the face of the buffing pad 11 against the surface of the wash plate. The biasing arrangement preferably comprises a plurality of compression springs 27 that are captured between the underside of the wash plate and the lower wash plate surface 23. Each of the compression springs is mounted on a stud 28 that depends downwardly from the underside of the wash plate and is preferably insert molded therein. The lower end of the stud extends through the lower support surface 23 of the base plate and is held in place with an initial level of compression by a connector 30 which preferably comprises a nut/washer assembly 31 threaded onto the lower end of the stud 28. The stud extends through openings in the base plate defined by a tubular guide sleeve 32 that is formed integrally with the lower support surface 23 of the base plate. The compression spring assemblies are shown in detail in FIG. 6.

Figure 7:
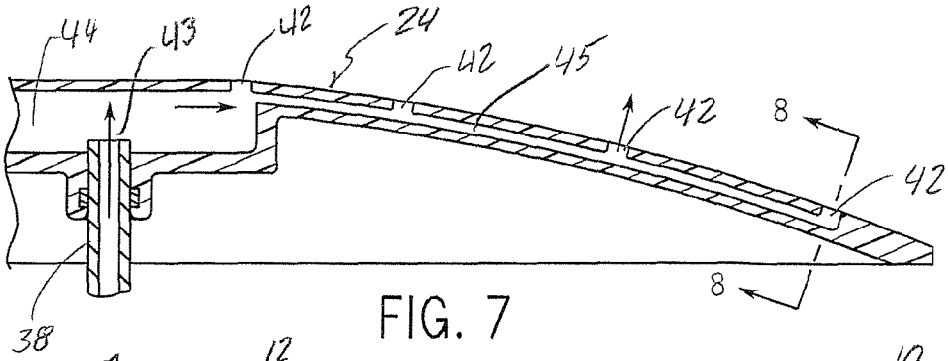
FIG. 7 is an enlarged detail of the wash plate taken on line 7-7 of FIG. 5.
Figure 9:
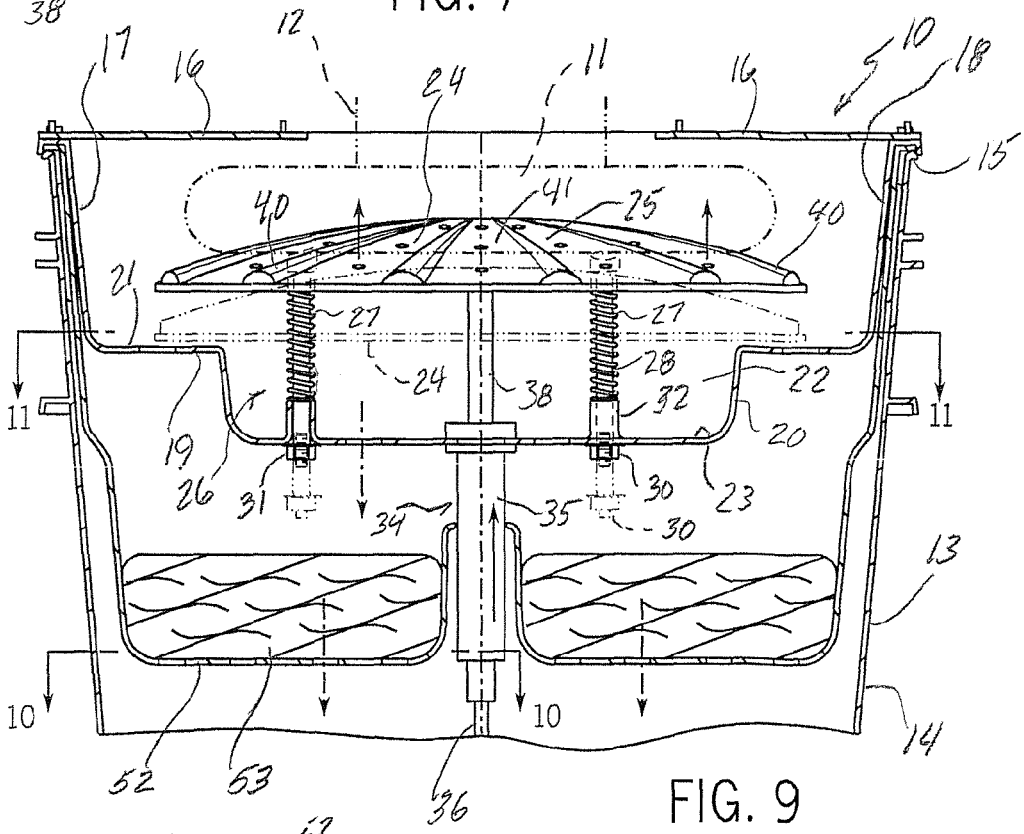
FIG. 9 is a sectional side view of the apparatus similar to FIG. 3.
Figure 10:
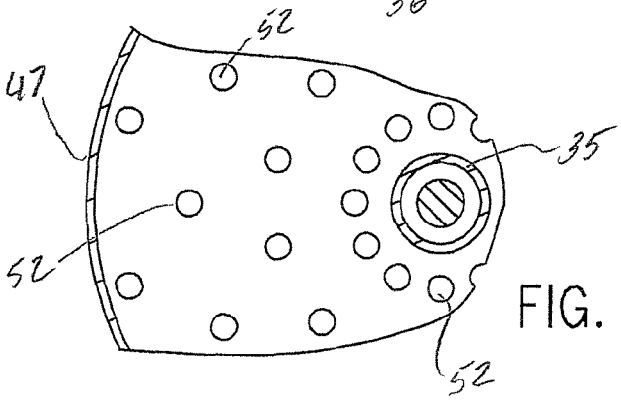
FIG. 10 is a detail horizontal section taken on line 10-10 of FIG. 7.
Figure 11:
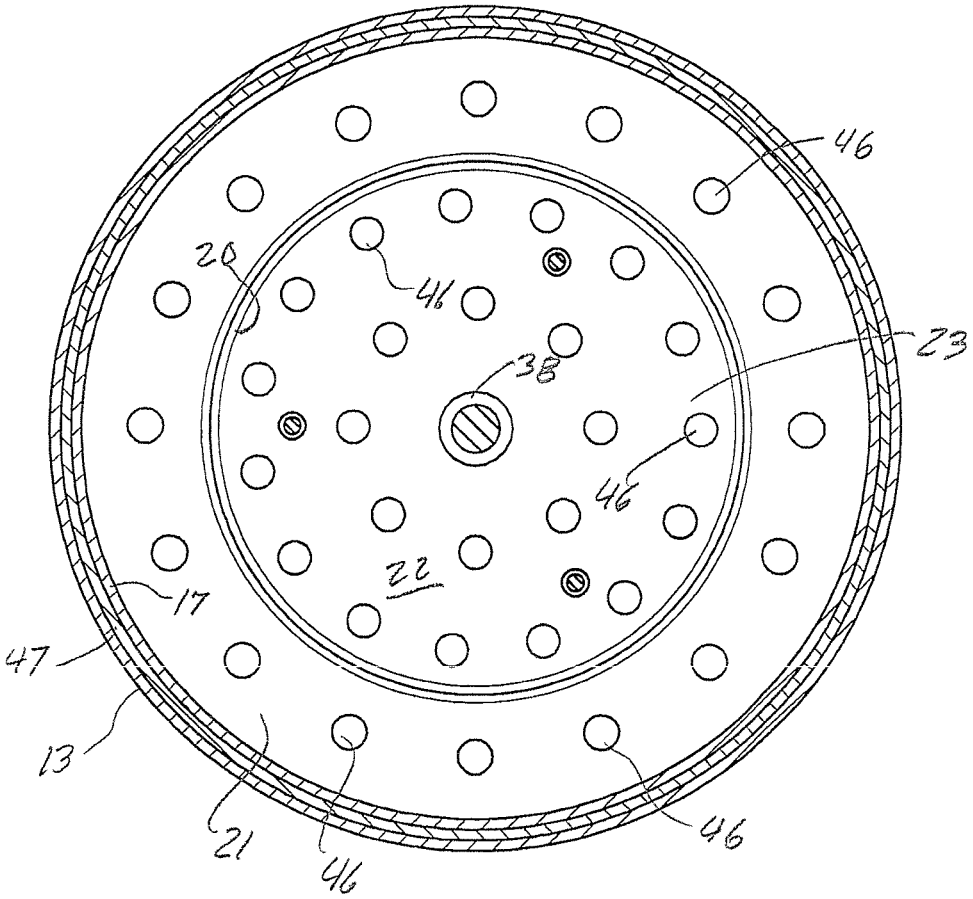
FIG. 11 is a horizontal section taken on line 11-11 of FIG. 9.

As is best seen in FIG. 3 and FIG. 9, downward movement of the wash plate 24 against the bias of the coil springs 27 causes the ends of the studs 28 to move downwardly through the guide sleeves 32 and away from the bottom of the base plate lower support surface 23. Downward movement of the wash plate 24 is limited by contact of the under surface of the wash plate with the outer upper support surface 21 of the base plate, as may be seen in FIG. 3. A liquid cleaning solution 33 is supplied to and through the foraminous upper surface 25 of the wash plate 24 by a positive displacement pump 34 operated by reciprocal movement of the wash plate by the operator holding the power driver 12 while it is operating to rotate the buffing pad 11. Referring also to FIG. 4, the pump includes a pump body 35 having an upper end that extends through and is secured in the lower support surface 23 of the base plate. A cleaning solution inlet line 36 extends downwardly into the cleaning solution in the reservoir 13 to an inlet 37. Extending from the upper end of the pump body 35 is a spring-biased plunger having an upper end that is secured to the underside of the wash plate 24 as best shown in FIG. 7. Biased vertical reciprocal movement of the wash plate by the driver operator delivers cleaning solution through the plunger 38 and through the foraminous surface 25 of the wash plate into washing contact with the buffing pad 11. Thus, vertical movement of the pump plunger 38 is controlled and operates in unison with vertical movement of the spring-biased studs 28.

Figure 5:
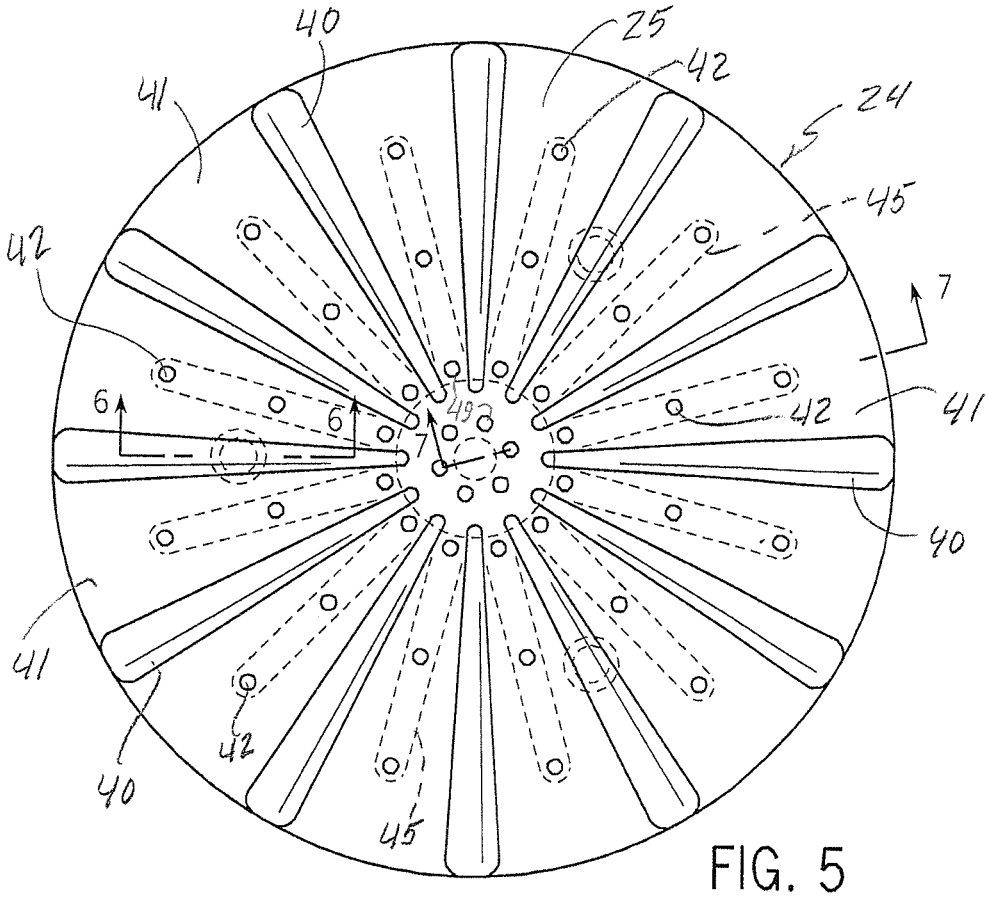
FIG. 5 is a top plan view of the wash plate taken on line 5-5 of FIG. 3.
Figure 8:
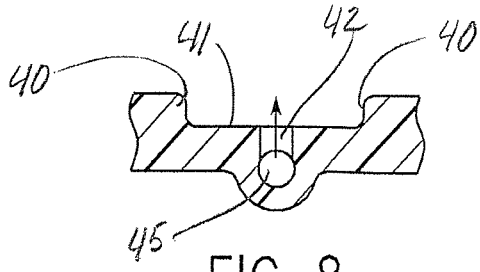
FIG. 8 a sectional detail taken on line 8-8 of FIG. 7.

Referring also to FIGS. 5, 7 and 8, the wash plate 24 has an inverted dish-shaped upper surface 25 that slopes downwardly in a radially outer direction. The pad contacting surface of the wash plate includes a plurality of circumferentially spaced radial ribs 40 that are separated by recessed radial surface portions 41. The surface portions are provided with radially extending lines of outlet holes 42 that define the foraminous surface of the wash plate. The upper outlet end of the pump plunger 38 is connected to a cleaning solution distribution chamber 44 from which the solution is forced by pump action into radially extending feeders 45 to the outlet holes 42. Instead of or in addition to the lines of outlet holes 42, two concentric center rings of holes 49 may be used, as best seen in FIG. 5.

To facilitate the return of cleaning solution from the wash plate to the reservoir, the upper and lower support surfaces 21 and 23 of the base plate are provided with drain holes 46. Cleaning fluid returning to the reservoir via the drain holes 46 may pass directly into the lower portion of the reservoir.

However, the apparatus of the present application also includes an optional catch basin 47 that depends downwardly from the base plate 17 and is demountably attached thereto. The catch basin has an annular bottom chamber 48 that defines a tubular vertical opening 50 through which the pump body 35 extends. The bottom wall 52 of the catch basin may be provided with drain holes 51 when the basin is used in one of several operating modes. If the catch basin has open drain holes 51, a replaceable cleaning solution filter 53 may be placed in the bottom chamber 48. Optionally, the bottom wall 52 of the catch basin may be provided with a plurality of knock-out plugs 54 which, when removed, define the drain openings.

By using a closed bottom catch basin 47, and positioning the pump inlet 37 at a selected height in the reservoir, the volume of the catch basin can be matched to the initial volume of cleaning solution in the reservoir. Thus, when the catch basin is full, the reservoir must be refilled and the catch basin emptied. Correspondingly, when delivery of cleaning solution stops, the reservoir will be empty and the catch basin full.

As shown in the FIG. 4A detail, a plurality of circumferentially spaced bayonet connectors 55 permit the catch basin 47 to be removed from the base plate 17. Each of the bayonet connectors 55 includes a radially projecting lug near the upper peripheral edge of the base plate and an L-shaped slot 57 into which the lug is locked in response to relative vertical and horizontal movement of the lug into the slot. The catch basin 47 may also be attached to the underside of the base plate 17, e.g. to the upper support surface 21 using a similar connector.

The inverted dish-shaped wash plate 24 provides a number of operational advantages. The radial ribs 40 are, of course, stationary and functionally replace the agitating wheels typical of prior art pad washing apparatus. Regardless of the type of power driver used (rotary, random orbital or dual action), the ribs will provide good contact by the buffing pad face to loosen dirt and caked buffing compound from the pad 11. The radial arrangement of the ribs 40 and the cleaning solution outlet holes 42 facilitate return of the cleaning solution to the reservoir when the cleaning process is completed. If the wash plate 24 is held down, so that there is no pumping action, removal of cleaning solution squeezed from the pad is facilitated by allowing it to move radially outwardly and downwardly for the outer edge by centrifugal force of the rotating pad. Indeed, the operator may wish to remove cleaning solution as an intermediate step by holding the pad down and then resuming pumping action.

The present application also contemplates use of the pad washing apparatus to be used to clean pads and wash mitts, and any other type of hand-held applicator or device for cleaning or polishing, without being attached to a powered drive machine. In this manner, the operator may simply hold a pad or other device against the surface of the wash plate 24, reciprocate it vertically to activate the cleaning solution pump to bring solution into contact with the face of the pad. Simultaneously, the pad can be rubbed horizontally against the wash plate. In a similar manner, the cleaning or buffing mitt may also be cleaned without being power driven.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. An apparatus for cleaning a rotary, dual action or random orbital power driven buffing pad having a buffing face, while the pad is mounted on an operating buffing machine, the apparatus comprising:

a reservoir for a liquid cleaning solution including an outer wall having a peripheral upper edge defining an open upper end;

a base plate supported on the upper edge of the reservoir and having an outer wall extending downwardly into the open upper end, the base plate having an annular support surface;

a wash plate having a foraminous upper surface supported over the base plate support surface and connected thereto with a biasing arrangement adapted to permit vertical movement of the wash plate in response to manual downward operator movement of the buffing pad face against the surface of the wash plate;

a positive displacement pump mounted in the reservoir, the pump having a cleaning solution inlet on a lower end and a housing including a cleaning solution outlet on an upper end in a closed path providing pressurized liquid communication with the upper surface of the wash plate, the pump housing attached to the base plate support surface and having a spring-biased pump actuating plunger, including the cleaning solution outlet, in operative engagement with a lower wash plate surface to deliver cleaning solution from the pump outlet into the wash plate, through the foraminous surface of the wash plate and against the pad face in response to the downward operator movement.

2. The apparatus as set forth in claim 1, wherein the biasing arrangement comprises a plurality of compression springs captured between the lower wash plate surface and the base plate support surface.

3. The apparatus as set forth in claim 2, wherein the wash plate has an inverted dish-shaped upper surface;

a plurality of circumferentially spaced radial ribs separated by recessed radial upper surface portions, the upper surface portions provided with outlet holes defining the foraminous surface.

4. The apparatus as set forth in claim 2, wherein the studs are insert molded in an underside of the wash plate.

5. The apparatus as set forth in claim 2, wherein each of the compression springs is mounted on a stud depending downwardly from an underside of the wash plate, the lower end of the stud extending through the base plate support surface and held by a connector attached to the lower end of the stud to place the springs in an initial level of compression and to permit the stud end and connectors and the wash plate to move downwardly to cause a higher level of compression in response to the downward operator movement.

6. The apparatus as set forth in claim 5, wherein downward movement of the wash plate is limited by contact of the lower wash plate surface with the annular support surface of the base plate.

7. The apparatus as set forth in claim 6, wherein the outer wall of the base plate includes an annular shoulder defining a radially outer upper support surface and a central recess defining a lower support surface.

8. The apparatus as set forth in claim 7, wherein the upper support surface comprises the limit to downward vertical movement of the wash plate.

9. The apparatus as set forth in claim 7, comprising drain holes in the upper support surface and the lower support surface.

10. The apparatus as set forth in claim 5, including a tubular guide sleeve positioned on the stud between each compression spring and the base plate support surface to confine the stud to vertical movement.

11. The apparatus as set forth in claim 10, wherein the guide sleeves are formed integrally with the base plate.

12. The apparatus as set forth in claim 1, including a catch basin receiving and demountably attached to the base plate, the catch basin having an annular bottom chamber defining a vertical opening for receipt therethrough of the pump housing.

13. The apparatus as set forth in claim 12, wherein the bottom chamber of the catch basin includes drain holes for the return of cleaning solution to the reservoir.

14. The apparatus as set forth in claim 13, including a replaceable cleaning solution filter in the bottom chamber.

15. The apparatus as set forth in claim 1, including a removable lid operatively supported on the upper edge of the reservoir and movable to an open position to receive the buffing pad and to a closed position for cleaning.

16. An apparatus for cleaning a rotary, dual action or random orbital power driven buffing pad having a buffing face, while the pad is mounted on an operating buffing machine, the apparatus comprising:

a reservoir for a liquid cleaning solution including an outer wall having a peripheral upper edge defining an open upper end;

a base plate supported on the upper edge of the reservoir and having an outer wall, the wall including an annular shoulder defining a radially outer upper support surface and a central recess defining a lower support surface;

a foraminous wash plate supported over the base plate, the wash plate having a circular outer edge portion spaced vertically above the upper support surface in a rest position;

the wash plate connected to the base plate with a biasing arrangement positioned between the underside of the wash plate and the lower support surface, the biasing arrangement operative to hold the wash plate in the rest position and to permit vertical downward movement of the wash plate to a stop position in contact with the upper support surface in response to manual downward operator movement of the pad face against the wash plate; and, a pump having an inlet for cleaning solution in the reservoir and an outlet in liquid a closed path providing pressurized communication with a chamber on the underside of the wash plate, the pump having a spring-biased pumping plunger operable in response to biased vertical reciprocal movement of the wash plate to deliver pressurized cleaning solution to the chamber, through the foraminous wash plate and against the face of the pad.

17. The apparatus as set forth in claim 16 wherein the biasing arrangement and the pump plunger extend downwardly from the wash plate into the base plate central recess.

18. The apparatus as set forth in claim 17 wherein the upper support surface and the lower support surface are provided with drain holes.

19. The apparatus as set forth in claim 16 wherein the pump includes a pump housing attached to and extending through the lower support surface of the base plate.

20. An apparatus for cleaning a rotary, dual action or random orbital power driven buffing pad while the pad is mounted on an operating huffing machine, the apparatus supported on the rim of and extending downwardly into an open-ended reservoir containing a liquid cleaning solution, the apparatus comprising:

a base plate supported on the rim of the reservoir, the base plate having a cylindrical outer wall and a lower enclosing support surface;

a foraminous wash plate supported over the base plate support surface with a biasing arrangement positioned between an underside of the wash plate and the support surface, the biasing arrangement operative to hold the wash plate in a rest position and to permit vertical downward movement of the wash plate relative to the base plate to a stop position in response to manual downward operator movement of the pad face against the wash plate; and, a pump having an inlet for cleaning solution in the reservoir and an outlet in liquid communication with the underside of the wash plate, the pump having a spring-biased pumping plunger operable in response to biased vertical reciprocal movement of the wash plate to deliver pressurized cleaning solution to a chamber in the underside of the wash plate, through the foraminous wash plate and against the face of the pad.

21. The apparatus as set forth in claim 20 including a catch basin demountably attached to the base plate and extending downwardly from the base plate support surface.

22. The apparatus as set forth in claim 21 wherein the catch basin has a lower bottom wall having drain openings for returning cleaning solution to the reservoir.

23. The apparatus as set forth in claim 22 wherein the lower bottom wall is provided with a plurality of knock-out plugs defining, when removed, the drain openings.

* * * * *